United States Patent [19]

Thompson

[11] 4,139,884

[45] Feb. 13, 1979

[54] LUMINAIRE LOWERING DEVICE

[75] Inventor: Richard L. Thompson, Hendersonville, N.C.

[73] Assignee: General Electric Company

[21] Appl. No.: 826,497

[22] Filed: Aug. 22, 1977

[51] Int. Cl.[2] ..... F21S 1/02

[52] U.S. Cl. ..... 362/430; 362/431; 362/433

[58] Field of Search ..... 362/145, 418, 430, 431, 362/433

[56] References Cited

U.S. PATENT DOCUMENTS 3,686,498 8/1972 Meyer ..... 362/431

*Primary Examiner*—Stephen J. Lechert, Jr.

*Attorney, Agent, or Firm*—Sidney Greenberg

[57] ABSTRACT

Lowering and hoisting apparatus for high mast luminaires. Support ring carrying a plurality of luminaires is mounted for movement along a pole from an upper operative position, in which it is latched to an upper support, to a lowered position near the ground for servicing operations. The latching arrangement comprises a plurality of latches on the support ring which automatically latch the support ring to the upper support when raised to its operative position, and are automatically unlatched from the upper support when the luminaire support ring is slightly raised from its operative position so that the support ring may be lowered to its service position.

9 Claims, 6 Drawing Figures

LUMINAIRE LOWERING DEVICE

The present invention relates to luminaire supports and more particularly to hoisting apparatus for raising and lowering a luminaire support on a pole.

It is an object of the invention to provide an improved luminaire hoist apparatus for raising and lowering a luminaire support on a pole.

It is another object of the invention to provide a hoist apparatus of the above type having an improved latching mechanism for holding the luminaire support at the top of the pole.

Still another object of the invention is to provide a latching mechanism of the above type for automatically latching the luminaire support at its upper position when raised and for automatically unlatching the luminaire support when the latter is to be lowered.

Other objects and advantages will become apparent from the following description and the appended claims.

With the above objects in view, the present invention in one of its aspects relates to luminaire hoist apparatus comprising, in combination, a pole, a fixed support secured at the top of the pole and having latch locking means, a luminaire mounting member, hoist means connected to the mounting member and the pole for raising the mounting member to an upper operative position and lowering the mounting member to a lower service position on the pole, cam means secured to the mounting member for movement therewith, the cam means comprising a tubular member having upper and lower recesses, each formed with a cam surface, an elongated latch member extending at its lower end into the tubular cam member and axially movable relative thereto, and having portions engageable with the upper and lower cam surfaces, resilient means associated with the tubular member urging the latch member upwardly from the tubular cam member, the latch member coacting with the cam means for engaging the latching locking means when the mounting member is raised to its upper position and for disengaging the locking means when the mounting member is slightly raised from its upper position for permitting the mounting member to be lowered to its service position.

The invention will be better understood from the following description taken in conjunction with the accompanying drawings, in which.

Figure 3:
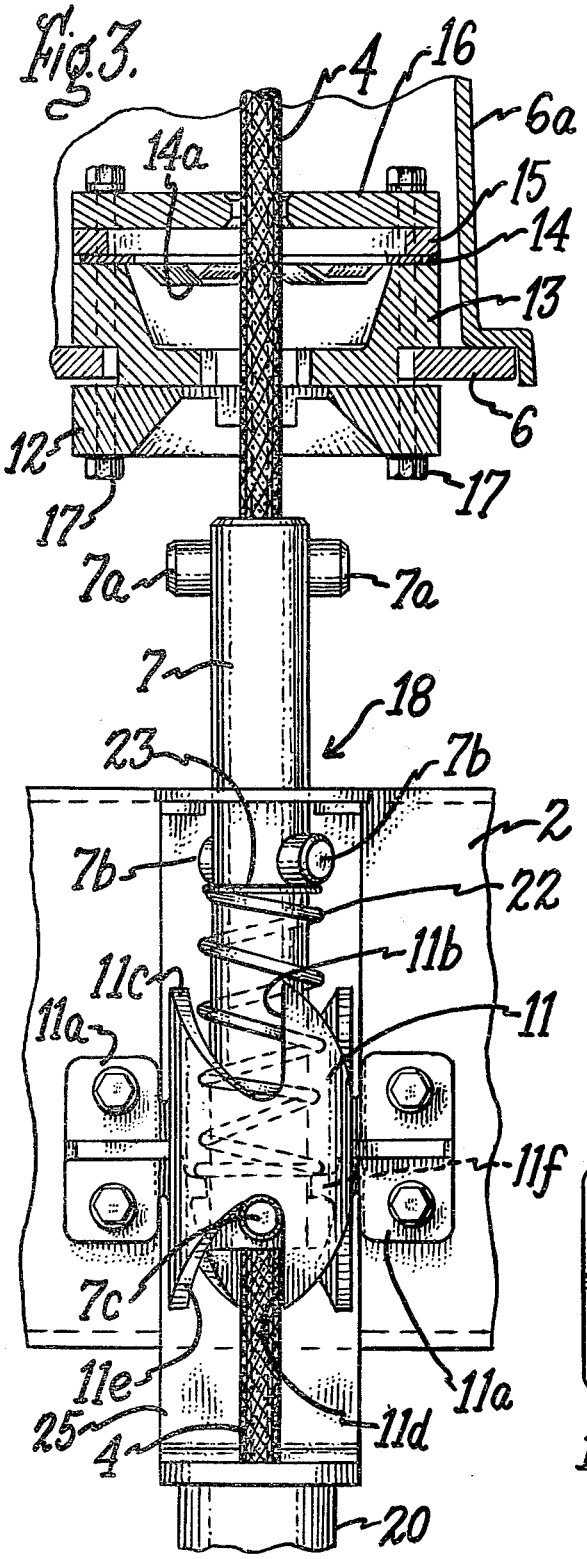
FIG. 3 is an enlarged detail view of the latching device.
Figure 3A:
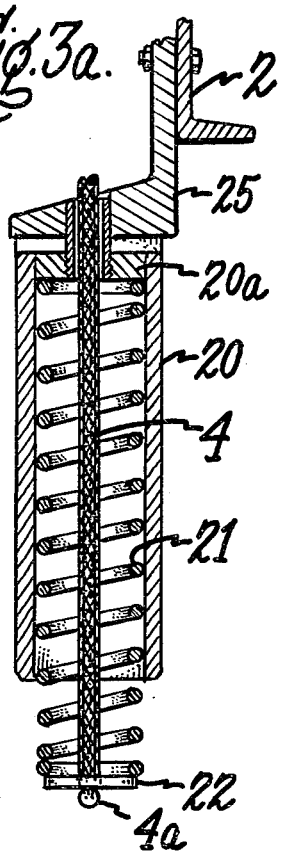
Figure 4:
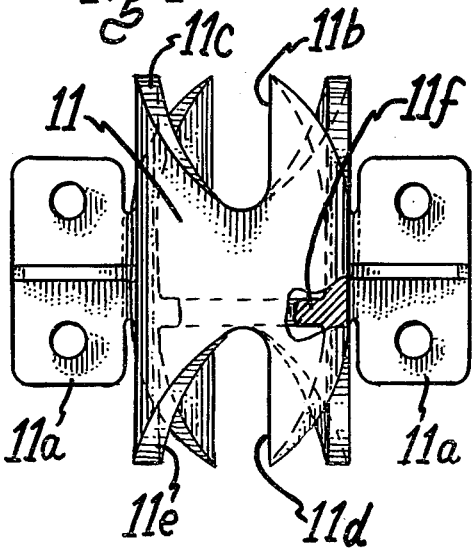
Figure 5:
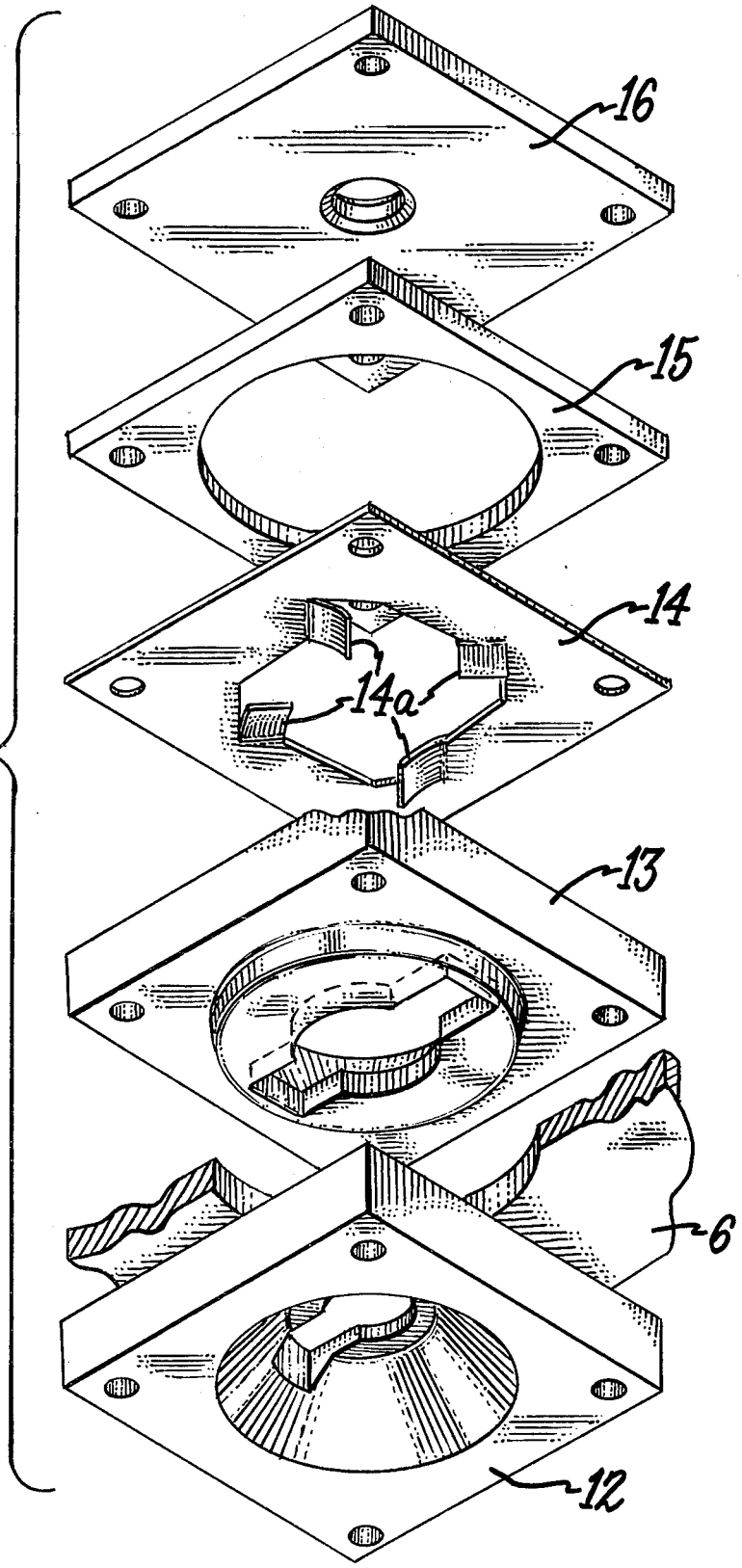

FIG. 3*a* is a similar view of the spring connection of the hoisting cable to the luminaire mounting ring;

FIG. 4 is a view in elevation of the tubular cam component of the latching device; and FIG. 5 is an exploded perspective view of the elements of the latch receiving and locking portion of the latching apparatus.

Figure 1:
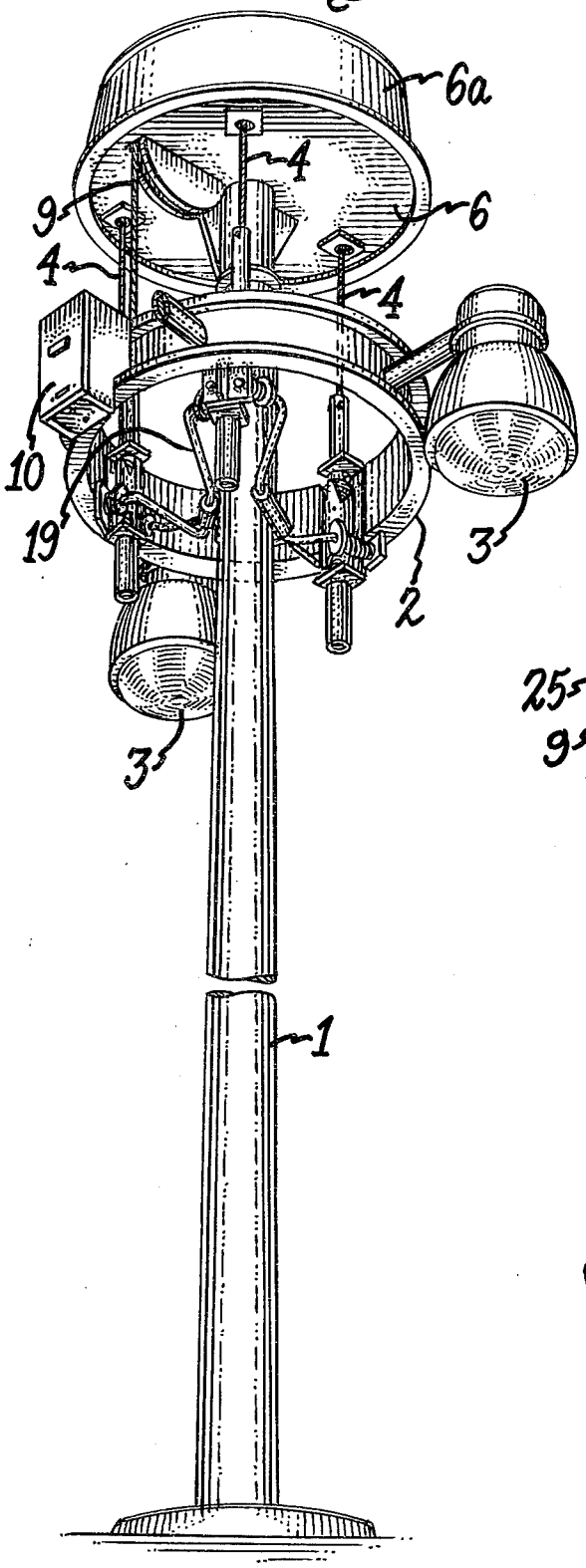
FIG. 1 is a perspective view of a luminaire mounting ring arranged on a pole with hoist means for raising and lowering the mounting ring, and having latching devices in accordance with an embodiment of the invention.
Figure 2:
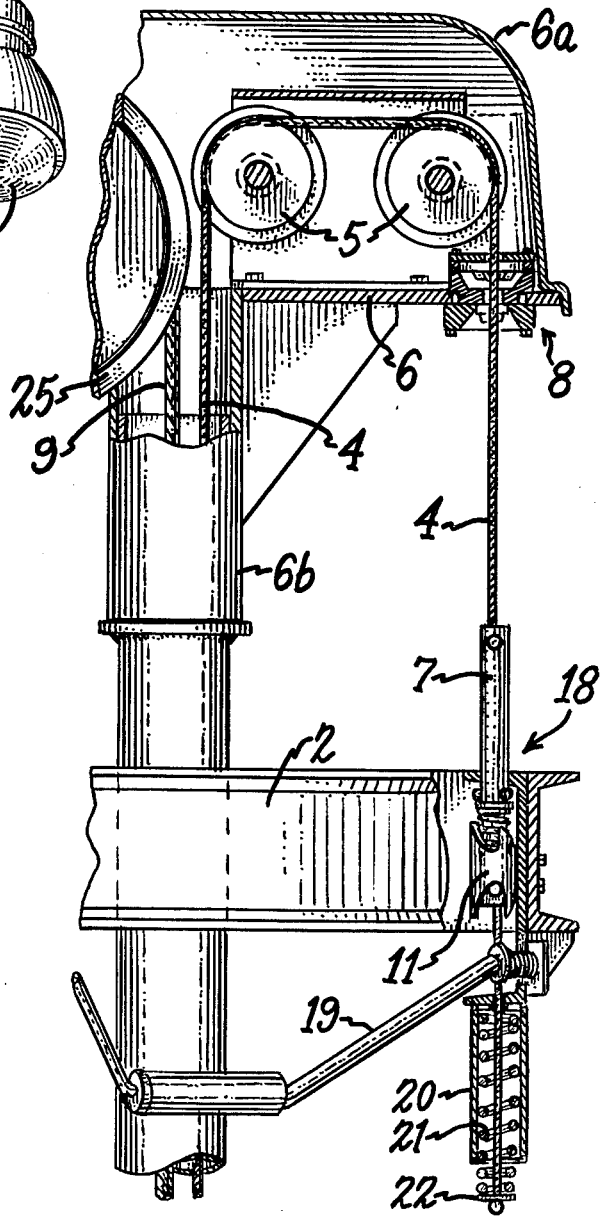
FIG. 2 is a view of the upper portion of the pole and luminaire support assembly, with parts broken away, showing elements of the latching device.

Referring now to the drawings, and particularly to FIGS. 1 and 2, there is shown light pole 1 of high-mast type which is of tubular shape tapering somewhat toward its upper end. Mounted on the top of pole 1 is head plate 6 having a dome-shaped cover 6*a* and sleeve (slipfitter) 6*b* which fits over the top portion of the pole. Surrounding pole 1 is luminaire support ring 2 having secured thereto a number of luminaires 3 uniformly spaced around the support ring. A plurality of hoisting cables 4 (typically three) secured to support ring 2 pass over correspondingly arranged pairs of sheaves 5 (see FIG. 2) mounted on head plate 6 and extend downwardly through the interior of the pole to suitable motorized winch apparatus near the bottom of the pole (not shown), which is operable for raising and lowering luminaire support ring 2 by winding and unwinding cables 4. Support ring 2 is held in its uppermost (operative) position by a plurality of latch shafts 7 mounted on ring 2 to which hoist cables 4 are respectively attached and which engage latch locking devices 8 correspondingly arranged on head plate 6.

Power cable 9, connected at one end to wiring box 10 secured to support ring 2 for transmitting current to luminaires 3, passes around power cable sheave 25 and downward through pole 1 for connection to a power source (not shown) near the bottom of the pole.

Apparatus comprising spring loaded guide members 19 for maintaining support ring 2 substantially centered relative to pole 1 and for preventing impact shock to the luminaires mounted on ring 2 is shown and described more fully in copending Thompson application Ser. No. 818,368, filed July 25, 1977, (Docket 410D-5445) and assigned to the same assignee as the present invention.

Each of the latching mechanisms comprises an upper latch assembly 8 secured to head plate 6 and a lower latch assembly 18 which includes latch shaft 7 and tubular cam 11 mounted on support ring 2. Upper latch assembly 8, as seen in FIGS. 3 and 5, comprises lead-in plate 12, lock plate 13, spring plate 14, stop-plate spacer 15, and stop-plate 16, all superimposed on one another as shown. The superimposed members are arranged on head plate 6 with the openings therein and in head plate 6 in alignment with one another and the transverse (keyhole) slots in lead-in plate 12 and lock plate 13 which are in register with each other, and bolts 17 hold the superimposed members in assembly on head plate 6 in such manner as to allow the assembly to slide about radially a short distance from its centered location in any direction on the surface of head plate 6. Such freedom of motion assures alignment of the upper and lower latch assemblies. In the illustrated device, this limited motion is achieved by providing lock plate 13 with a lower portion which extends into the opening of head plate 6 and is of smaller diameter than the latter opening, as shown. Lead-in plate 12 is formed with a downwardly flaring opening communicating with its keyhole slot for receiving and guiding latch 7 into the slot, as described below.

Lower latch assembly 18 is attached to luminaire support ring 2 by bolts extending through the opposite flanges 11*a* of tubular cam 11. Cable 4 passes downwardly through tubular latch shaft 7 and into spring housing 20 which is secured by channel member 26 to support ring 2 and contains coil spring 21. As seen in FIG. 3*a*, the end of cable 4 has a terminal 4*a* engaging washer 22 which bears on the bottom of spring 21. The upper end of spring 21 bears against plug 20*a* in the top of housing 20. Latch shaft 7 has a pair of upper pins 7*a*, a pair of intermediate pins 7*b* and a pair of lower pins 7*c* projecting laterally in opposite directions, with intermediate pins 7*b* extending in a direction about 45° from the direction in which the other pins extend. Latch shaft 7 is free to rotate about its vertical axis and to move up and down along this axis subject, however, to constraint by the coaction of its intermediate and lower pins *7b, 7c* with cam 11, as described more fully below.

As seen in FIGS. 3 and 4, tubular cam 11 is formed on its top and bottom ends with four similar recesses spaced uniformly around the cam, each upper recess having an axially extending surface 11*b* and an inclined cam surface 11*c*, and each lower recess having an axial surface 11*d* and an inclined cam surface 11*e*. Coil spring 22, which surrounds latch shaft 7, extends upwardly from cam 11, resting at its bottom on annular ledge 11*f* formed on the interior of cam 11 and bearing at its top against intermediate pins *7b* by means of intervening washer 23.

The operation of the latching mechanism is as follows. When cables 4 are pulled downwardly inside pole 1, luminaire support ring 2 is raised by virtue of lower shaft pins *7c* engaging the lower cam surfaces 11*e* of cam 11 as shown in FIG. 3. Such engagement aligns upper shaft pins *7a* with the keyhole slots in lead-in plate 12 and lock plate 13. Continued pulling of cable 4 causes latch shaft pins *7a* to enter and pass through plates 12 and 13 until the top of latch shaft 7 strike stop plate 16, resulting in the upper end of cam 11 coming into contact with intermediate shaft pins *7b* as spring 22 is compressed. At this point, upper pins *7a* are about the same plane as spring tabs 14*a* projecting from the underside of spring plate 14. Further pulling of cable 4 forces shaft pins *7b* to slide against inclined cam surfaces 11*c*, causing latch shaft 7 to rotate about 45° in a forward direction. Upon such rotation, upper shaft pins *7a* move past the spring tabs 14*a* in their path, and the spring tabs 14*a* thus snap into position behind shaft pins *7a*, thereby preventing latch shaft 7 from rotating backwardly. When the pulling force on cable 4 is then released, cam 11 drops along with support ring 2. As this occurs, cam 11 drops out of engagement with intermediate shaft pins *7b* and into engagement with lower shaft pins *7c*, which contact and slide along the inclined cam surfaces 11*e* at the bottom of the cam member, thereby further forwardly rotating latch shaft 7 about 45°, as latch 7 drops. When latch shaft 7 drops sufficiently, its upper pins *7a* rest on lock plate 13, and then coil spring 22 fully elongates as the support cables 4 are relieved of the weight of support ring 2. Upper shaft pins *7a* are thus oriented perpendicular to the keyhole slot in lock plate 13 and the device is in fully latched position, with the full weight of luminaire support ring 2 resting on lower latch pins *7c* as the latch shaft 7 hangs from lock plate 13 by means of its upper pins *7a*.

To disengage the latch, the described procedure is reversed. Cable 4 is first pulled downwardly, causing the top of latch shaft 7 to strike stop plate 16, and further pulling lifts cam 11 so that its upper cam surfaces contact intermediate latch pins *7b*, resulting in 45° forward rotation of the latch shaft. This shaft position is maintained by spring plate 14 until, upon release of cable tension, the lower cam surraces of cam 11 contact the lower shaft pins *7c*, causing a final 45° forward rotation of the latch shaft. This aligns upper shaft pins *7a* with the keyhole slots in lock plate 13 and lead-in plate 12, allowing the luminaire support ring assembly to drop freely toward the bottom of the pole.

Coil spring 21, which serves primarily as a shock absorbing means during the hoisting operation, and spring plate 14, which prevents undesired reverse rotation of latch shaft 7, are not always necessary and may be dispensed with in appropriate situations.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Luminaire hoist apparatus comprising, in combination, a pole, a fixed support secured at the top of said pole and having latch locking means, a luminaire mounting member, hoist means connected to said mounting member and said pole for raising said mounting member to an upper operative position and lowering said mounting member to a lower service position on said pole, cam means secured to said mounting member for movement therewith, said cam means comprising a tubular member having upper and lower recesses each formed with a cam surface, an elongated latch member extending at its lower end into said tubular cam member and axially movable relative thereto, and having portions engageable with said upper and lower cam surfaces, resilient means associated with said tubular member urging said latch member upwardly from said tubular cam member, said latch member coacting with said cam means for engaging said latch locking means when said mounting member is raised to its upper position and for disengaging said locking means when said mounting member is slightly raised from said upper position for permitting said mounting member to be lowered to its service position.

2. Apparatus as defined in claim 1, said portions of said latch member comprising upper, lower and intermediate projecting means, said upper projecting means engageable with said latch locking means and said lower projecting means engageable with said lower cam recesses for holding said luminaire mounting member in operative position, said intermediate projecting means engageable with said upper cam surfaces and said lower projecting means engageable with said lower cam surfaces for rotating said latch member in a predetermined direction to predetermined positions for engagement with and disengagement from said latch locking means.

3. Apparatus as defined in claim 2, said latch member being tubular, said hoist means comprising cable means passing from said pole freely through said latch locking means and said tubular latch member and being connected to said mounting member below said latch member.

4. Apparatus as defined in claim 3, including second resilient means yieldably connecting said cable means to said mounting member.

5. Apparatus as defined in claim 2, said latch locking means comprising a lock member having a laterally elongated aperture for passage therethrough of said upper projecting means of said latch member, and a stop member superposed relative to said lock member for limiting upward movement of said latch member.

6. Apparatus as defined in claim 3, and yieldable means arranged between said stop member and said lock member for permitting rotation of said latch member only in said predetermined direction.

7. Apparatus as defined in claim 5, said latch locking means including a lead-in member arranged below and in assembly with said superposed stop member and lock member, said lead-in member having a laterally elongated aperture in register with said aperture of said lock member and a downwardly flaring opening communicating with said aperture therein for guiding said latch member therethrough.

8. Apparatus as defined in claim 7, said assembly of stop member, lock member and lead-in member being mounted on said fixed support for limited lateral movement thereon.

9. Apparatus as defined in claim 1, said luminaire mounting member comprising a support ring extending around said pole, and a plurality of said cam means secured to said support ring at circumferentially spaced locations, and a correspondingly arranged plurality of latch members, latch locking means and resilient means as defined in claim 1 for coaction therewith.

* * * * *